US006067006A

United States Patent [19]

O'Brien

[11] Patent Number: 6,067,006

[45] Date of Patent: May 23, 2000

[54] PERSONAL AUDIBLE ALARM

[76] Inventor: Patricia A. O'Brien, 816 Sandra Pl., Brick, N.J. 08724

[21] Appl. No.: 09/082,784

[22] Filed: May 21, 1998

Related U.S. Application Data

[60] Provisional application No. 60/047,453, May 22, 1997.

[51] Int. Cl.[7] ..... G08B 3/00

[52] U.S. Cl. ..... 340/384.1; 340/575; 340/573; 340/825.19; 381/23.1; 381/312; 381/315

[58] Field of Search ..... 340/407.1, 573, 340/575, 539, 825.19, 384.1; 381/23.1, 312, 315, 60

[56] References Cited

U.S. PATENT DOCUMENTS

| | | | |
|---|---|---|---|
| 4,180,810 | 12/1979 | Muncheryan | 340/407 |
| 4,777,474 | 10/1988 | Clayton | 340/539 |
| 5,016,229 | 5/1991 | Gibbens, Jr. | 368/10 |
| 5,686,882 | 11/1997 | Giani | 340/407.1 |

*Primary Examiner*—Daryl Pope
*Attorney, Agent, or Firm*—Michaelson & Wallace; Peter L. Michaelson

[57] ABSTRACT

An audible alarm placed in an ear plug or hearing protection device intended to be worn by an individual user. Because the alarm of the present invention is incorporated into a ear plug or hearing protection device it can be heard by the user even in noisy conditions. The audio output of the alarm is located on the side of the earplug or hearing device which is open to or exposed to the user's ear canal but isolated from the external environment by the remaining portion of the ear plug or hearing protection device. Thus, individuals near the user are not exposed or annoyed to the audio output of the alarm to any significant degree. In addition, because the audio output is isolated from the ambient noise of the external environment and in close proximity to the user's ear, that output can be generated using relatively little power and heard even when there is a relatively large degree of ambient noise. For similar reasons, the alarm of the present invention is well suited for use by the hearing impaired which might require an unusually loud alarm that would be annoying to nearby individuals. The alarm of the present invention may also be used to inform a user, e.g., of waiting messages on an answering machine or of a telephone call without alerting nearby individuals to the condition, or in the case of the hearing impaired, with an audible signal that is close enough to their ear that they can hear the signal.

13 Claims, 3 Drawing Sheets

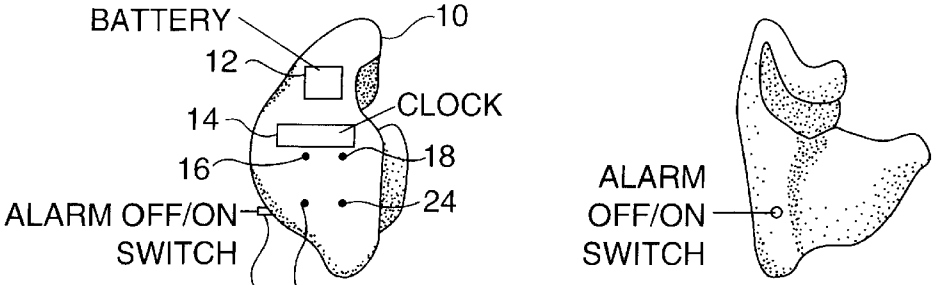
FRONT VIEW
FIG. 1A
SIDE VIEW
FIG. 1B
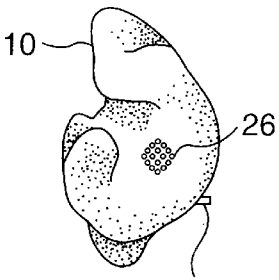
REAR VIEW
FIG. 1C
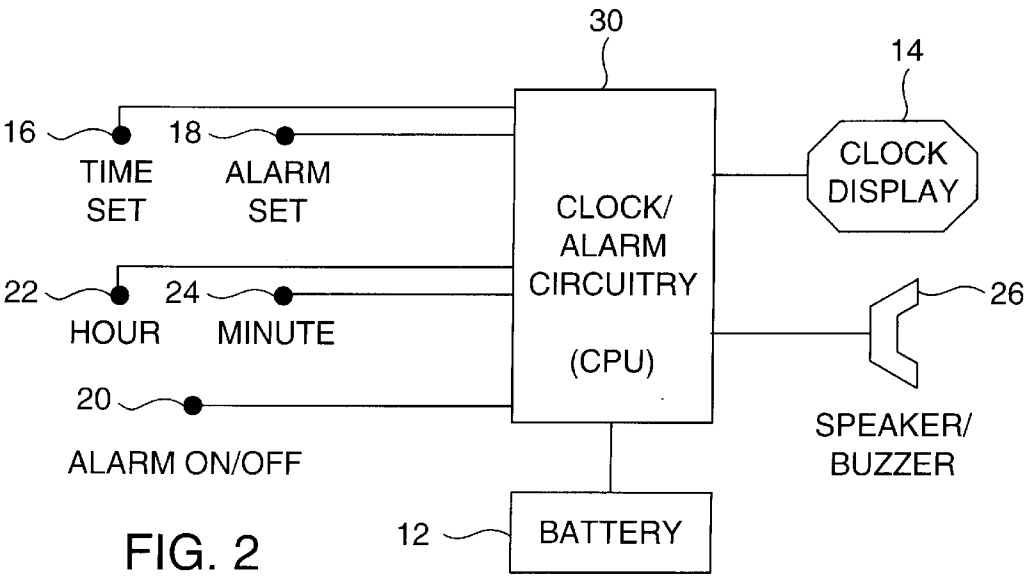
FIG. 2

PERSONAL AUDIBLE ALARM

RELATED APPLICATION

This application claims priority of my U.S. provisional patent application Ser. No. 60/047,453 filed May 22, 1997 which is hereby expressly incorporated herein by reference.

FIELD OF THE INVENTION

The present invention is directed to alarm devices, and more particularly to personal audible alarm devices which are intended to alert the user to an alarm, time or other status condition.

BACKGROUND OF THE INVENTION

In many instances an individual wishes to be alerted to a particular condition, e.g., time of day, that it is time to wake up, that there are phone messages waiting to be heard, etc., without disturbing other nearby individuals. In other cases, ambient noise conditions may be such that conventional audible alarms incorporated into, e.g., wrist watches, would not be sufficient to gain a wearers notice. In still other cases, e.g., at firing ranges and in noisy work conditions, the wearing of hearing protection devices may make it difficult to hear a conventional audible alarm.

While the conditions described above, present cases where conventional alarms may be unsuitable for use by people with ordinary hearing ability, special problems are presented when audible alarms are to be used by hearing impaired individuals. That is, for such individuals to hear an audible alarm, the alarm usually must be extremely loud and therefore often annoying to nearby individuals.

Accordingly, there is a need for improved audible alarms which may be used by individuals without disturbing others who are nearby. There is also a need for audible alarms which are suitable for use by people working in noisy conditions, who wear hearing protection devices or who are hearing impaired.

SUMMARY OF THE PRESENT INVENTION

The present invention is directed to personal audible alarm devices which are intended to alert the user to an alarm, time, or other status condition.

In accordance with the present invention, an audible alarm is placed in an ear plug or hearing protection device intended to be worn by an individual user of the audible alarm. The alarm of the present invention can be used to provide the wearer with a wake up signal or other time signal indicating significant times during the day, e.g., the passing of hours, lunch time, quitting time, etc. Because the alarm of the present invention is incorporated into a ear plug or hearing protection device, it can be heard by the user even in noisy conditions. Furthermore, because the audio output of the alarm is located on the side of the ear plug or hearing device which opens out to the user's ear canal but is isolated from the external environment by the remaining portion of the ear plug or hearing protection device, individuals near the user are not exposed or annoyed by the audio output of the alarm to any significant degree. In addition, because the audio output is isolated from the ambient noise of the external environment and in close proximity to the user's ear, that output can be generated using relatively little power and heard even when there is a relatively large degree of ambient noise. For similar reasons, the alarm of the present invention is well suited for use by the hearing impaired which might require an unusually loud alarm that would be annoying to nearby individuals.

The alarm of the present invention may also be used to inform a user, e.g., of waiting messages on an answering machine or of a telephone call without alerting nearby individuals to the condition, or in the case of the hearing impaired, with an audible signal that is close enough to their ear that they can hear the signal.

Many other features and embodiments of the present invention are described in detail below.

BRIEF DESCRIPTION OF THE DRAWINGS

FIGS. 1A, 1B and 1C illustrated a molded ear plug including an audible alarm in accordance with the present invention.

FIG. 2 illustrates circuitry for implementing the alarm portion of the molded ear plug illustrated in FIGS. 1A, 1B and 1C.

DETAILED DESCRIPTION

Figure 3:
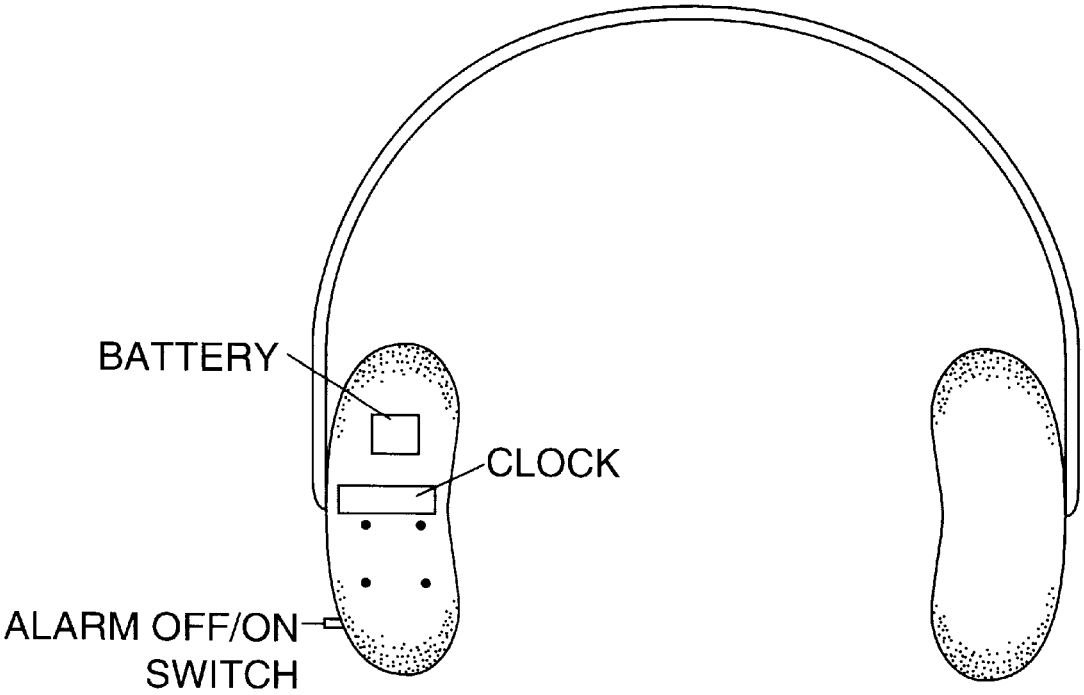
FIG. 3 illustrates a hearing protection device incorporating an audible alarm in accordance with another embodiment of the present invention.

FIGS. 1A, 1B and 1C illustrate a personal audible alarm device implemented in the form of a molded ear plug 10 in accordance with a first embodiment of the present invention. The ear plug 10 is made of rubber, silicone or another material suitable for being inserted into, or covering, an ear. The ear plug 10 includes a battery 12, clock display 14, time set switch 16, alarm set switch 18, hour set switch 22 and minute set switch 24. The ear plug 10 also includes an alarm off/on switch 20 and a speaker or buzzer 26 which is positioned so that sound exiting the device 26 will enter the user's ear canal. The on/off switch 20 may be implemented as a contact switch which activates the alarm when placed in contact with a user's ear and deactivated when removed. To facilitate operation of the switch 20, the switch 20 may be positioned in a location where it will make contact with the user's ear when the molded ear plug is inserted.

Referring now to FIG. 2, it can be seen that the various components are all coupled to clock/alarm circuitry 30, which is included in the ear plug 10 and may not be directly accessible or visible from the exterior of the ear plug 10. In one embodiment the clock alarm circuitry 30 may be the same as or similar to that presently used for implementing alarm watches.

Referring now to FIG. 3, there is illustrated another embodiment of the present invention wherein the alarm circuitry illustrated in FIG. 2 is incorporated into a hearing protection device, such as a set of headphones commonly worn by construction workers to protect their hearing from loud noises.

Figure 4:
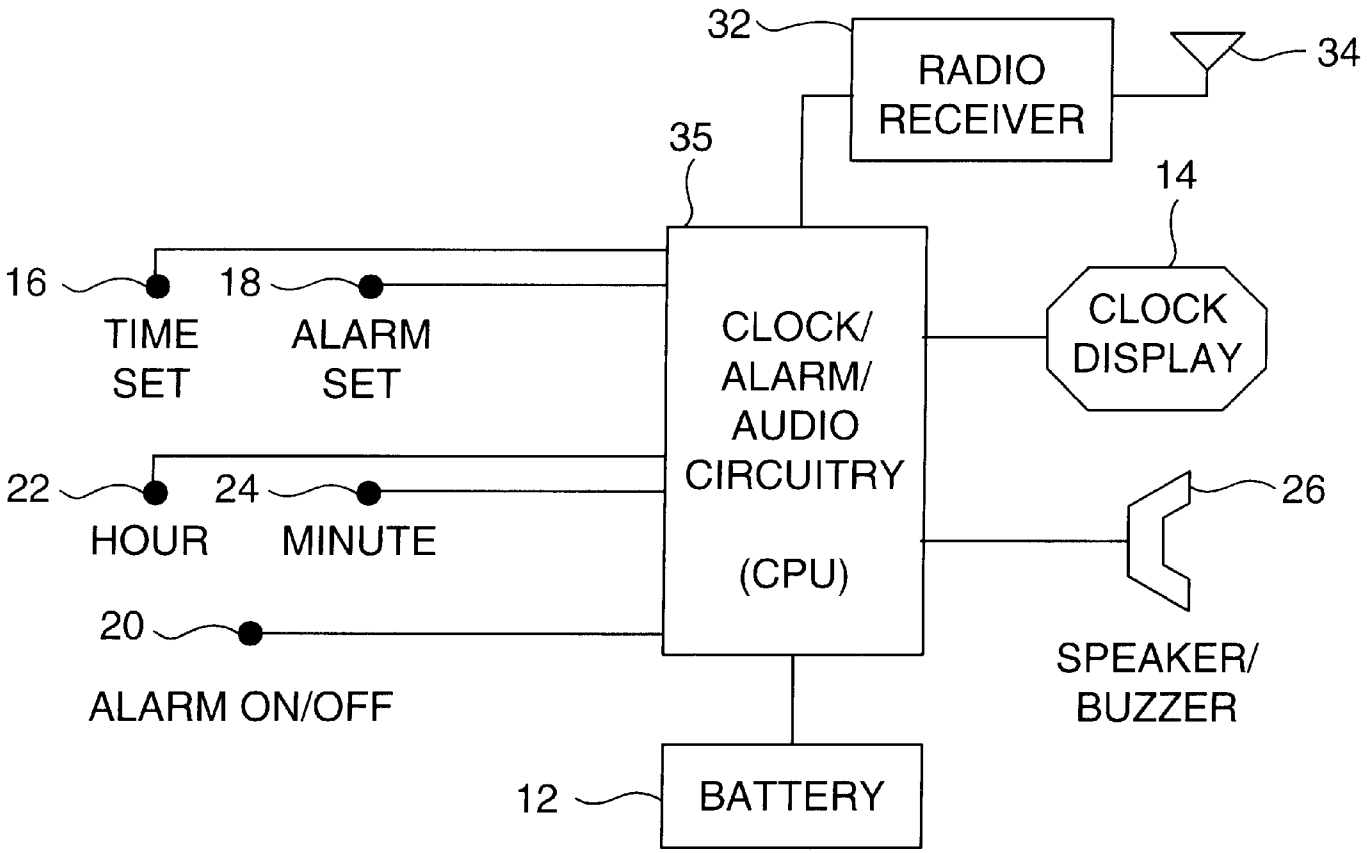
FIG. 4 illustrates an apparatus implemented in accordance with another embodiment of the present invention.

In addition to the basic clock alarm circuitry illustrated in FIG. 2, a receiver 32 may be included in the ear plug and or hearing device of the present invention to receive messages from, e.g., an answering machine, telephone, or pager service transmitted, e.g., by radio waives. Such an embodiment, illustrated in FIG. 4, may be used to notify a hearing impaired person of e.g., a telephone call or that messages are waiting on the answering machine. A small wire antenna 34, coupled to the radio receiver 32 may be included in the molded ear piece to improve reception of radio messages. Note that in the FIG. 4 embodiments, circuitry 35 which includes the ability to generate audio signals from the output of the radio receiver is used. Thus, in the FIG. 4 embodiment, the circuitry 35 can output audio messages in addition to clock and alarm signals.

By incorporating an alarm into an ear plug or hearing protection device in accordance with the present invention, alarms and other information can be provided to a user without alerting or annoying nearby individuals. For example, in the case of a couple sharing the same bed, one individual may be woken by the alarm without waking up the other individual in the bed.

Rather than simply making a buzzing sound the system of the present invention may provide a music alarm or a voice alarm and/or voice messages. Furthermore, the alarm of the present invention may use gentle tones as opposed to the harsh sounds commonly used with some alarms. Accordingly, the alarm of the present invention can be more soothing to wake up to than some known alarm clocks.

In addition, the apparatus of the present invention can generate different tones indicating which one of a plurality of answering machines a waiting message resides. For example, a first tone may indicate a business answering machine has waiting messages while a second, different tone indicates a home answering machine has waiting messages. The present invention also contemplates a pager-type system wherein an individual located at the radio transmitter could press a button which causes a tone to be generated by the apparatus of the present invention. Different tones may be used to indicate different locations which the apparatus user is to contact.

What is claimed is:

1. Apparatus for a device which is to be worn in abutting contact with an ear of a user, the apparatus comprising:

a housing adapted to be worn on the ear of the user or extending into an ear canal of the user;

a user-settable clock circuit contained within the housing for generating an output signal when a value of time maintained by the clock circuit reaches a time setpoint defined by the user, the clock circuit comprising at least one user-manipulative control, mounted on the housing and connected to the circuit, through which the user can manually program the setpoint into the circuit; and an acoustic transducer, connected to the clock circuit and mounted within the housing, for generating, in response to the output signal, an acoustic output, the transducer being oriented in the housing such that, when the device is worn by the user, the acoustic output is directed into the ear canal;

whereby the clock circuit and acoustic transducer are integrated into the device.

2. The apparatus of claim 1, further comprising a clock display device.

3. The apparatus of claim 1, wherein the housing is a custom molded housing made to fit the individual shape of the user's ear.

4. The apparatus of claim 1, wherein the housing seals the ear canal of the user when placed in contact with the ear to isolate the output of the acoustic transducer device from the environment external to the ear of the user.

5. The apparatus of claim 4, further comprising a radio receiver capable of receiving messages via transmitted radio signals.

6. The apparatus of claim 1, wherein the clock circuit periodically generates the output signal at preselected time intervals.

7. The apparatus of claim 6, wherein the housing seals the ear canal of the user when placed in contact with the ear to isolate the output of the audio signal generation device from the environment external to the ear of the user.

8. The apparatus of claim 1, wherein the housing is made of a flexible material.

9. The apparatus of claim 1, wherein the housing material is a sound absorbing material.

10. The apparatus of claim 9, wherein the housing is custom molded to fit the particular ear of the user.

11. The apparatus of claim 8, wherein the housing is made of a flexible rubbery material.

12. The apparatus of claim 11, wherein the rubbery material is silicone rubber.

13. The apparatus of claim 12, wherein the housing is custom molded to match the contour of the user's ear.

* * * * *